US005353373A

United States Patent [19]

Drogo de Iacovo et al.

[11] Patent Number: 5,353,373

[45] Date of Patent: Oct. 4, 1994

[54] SYSTEM FOR EMBEDDED CODING OF SPEECH SIGNALS

[75] Inventors: Rosario Drogo de Iacovo, Rocca Imperiale Marina; Roberto Montagna; Daniele Sereno, both of Turin, all of Italy

[73] Assignee: SIP - Societa Italiana per l'Esercizio delle Telecomunicazioni P.A., Turin, Italy

[21] Appl. No.: 803,484

[22] Filed: Dec. 4, 1991

[30] Foreign Application Priority Data

Dec. 20, 1990 [IT] Italy ..... 68029 A/90

[51] Int. Cl.[5] ..... G10L 9/14

[52] U.S. Cl. ..... 395/2.32; 381/36

[58] Field of Search ..... 381/36, 31; 395/2, 2.32

[56] References Cited

U.S. PATENT DOCUMENTS

| | | | |
|---|---|---|---|
| 4,817,157 | 3/1989 | Gerson | 381/40 |
| 4,852,179 | 7/1989 | Fette | 381/29 |
| 4,868,867 | 9/1989 | Davidson et al. | 381/31 |
| 5,185,796 | 2/1993 | Wilson | 380/21 |

FOREIGN PATENT DOCUMENTS

| | | | |
|---|---|---|---|
| 9101545 | 2/1991 | PCT Int'l Appl. | 381/36 |
| 9106943 | 5/1991 | PCT Int'l Appl. | 381/31 |

OTHER PUBLICATIONS

GLOBECOM '90 IEEE Global Telecommunications Conferrence & Exhibition, Dec. 2, 1990, M. Johnson et al.

ICASSP 88, Apr. 11, 1988, G. Davidson et al.

ICAASP '90 Apr. 3, 1990, Albuquerque, N. Mex. W. Y. Chan et al. pp. 1109-1112.

*Primary Examiner*—Michael R. Fleming
*Assistant Examiner*—Richard J. Kim
*Attorney, Agent, or Firm*—Herbert Dubno

[57] ABSTRACT

The set of possible excitation signals is subdivided into a plurality of subsets, the first of which provides the contribution to the coded signal necessary to set up a transmission at a minimum rate guaranteed by the network, while the others supply a contribution which, when added to that of the first subset, causes a rate increase by successive steps. At the receiving side, a decoded signal is generated by using the excitation contribution of the first subset alone if the coded signals are received at the minimum rate, while for rates higher than the minimum rate the contributions of the subsets which have allowed such rate increase are also used.

2 Claims, 4 Drawing Sheets

SYSTEM FOR EMBEDDED CODING OF SPEECH SIGNALS

FIELD OF THE INVENTION

The present invention relates to speech signal coding and, more particularly, to a digital coding system with embedded subcode using analysis by synthesis techniques.

BACKGROUND OF THE INVENTION

The expression "digital coding with embedded subcode", or more simply "embedded coding", indicates that within a bit flow forming the coded signal, there is a slower flow which can be still decoded giving an approximate replica of the original signal. Said codes allow coping not only with accidental losses of part of the transmitted bit flow, but also the the necessity of temporarily limiting the amount of information transmitted. The latter situation can occur in case of overload in packet-switched networks, e.g. these based on the so-called "Asynchronous Transfer Mode" better known as ATM, where a rate limitation can be achieved by dropping a number of packets or of bits in each packet. By using an embedded code, at the destination node the original signal is recovered, although at the expenses of a certain degradation by comparison with reception of the whole bit or packet flow. This solution is simpler than using a set of coders/decoders with different structure, operating at suitable rates and driven by network signaling for the choice of the transmission rate.

Among the systems used for speech signal coding, PCM (and more particularly uniform PCM with sample sign and magnitude coding) is per se an embedded code, since the use of a greater or smaller number of bits in a codeword determines a more or less precise reconstruction of the sample value. Other systems, such as e.g. DPCM (differential PCM) and ADPCM (adaptive differential PCM), where the past information is exploited to decode the current information, or systems based on vector quantization, such as analysis-by-synthesis coding systems, are not in their basic form embedded codings, and actually the loss of a certain number of coding bits causes a dramatic degradation in the reconstructed signal quality.

Coding-decoding devices based on DPCM or ADPCM techniques modified so as to implement an embedded coding are described in the literature E.g., the paper entitled "Embedded DPCM for variable bit rate transmission" presented by D. J. Goodman at the Conference ICC-80, paper 42-2, describes a DPCM coder-decoder in which the signal to be coded is quantized with such a number of levels as to produce the nominal transmission rate envisaged on the line, while the inverse quantizers operate with a number of levels corresponding to the minimum transmission rate envisaged. The predicators in the coder and decoder operate consequently on identical signals, quantized with the same quanitzaiton step. The resulting quality degradation has proved less than that occurring in case of loss of the same number of bits in conventional DPCM coding transmission. The paper also suggests the use of the same concept for speech packet transmission, since bit dropping causes a much lower degradation than packet loss, which is the way in which usually a transmission rate is reduced under heavy traffic conditions.

In the paper entitled "Missing packet recovery of low-bit-rate coded speech using a novel packet-based embedded coder", presented by M. M. Lara-Barron and G. B. Lockhart at the Fifth European Signal Processing Conference (EUSIPCO-90), Barcelona, Sep. 18–21, 1990, a speech signal embedded coding system is disclosed which is just studied for packet transmission in order to limit degradation in case of loss or dropping of entire packets instead of individual bits. The general coder structure basically reproduces that of the embedded DPCM coder described in the above-mentioned paper by D. J. Goodman. The system is based on a classification of packets as "essential" and "supplementary" and the network, in the case of overload, preferentially drops supplementary packets. For such a classification, a current packet is compared with its prediction to determine the degradation which would result from reconstruction at the receiver, the degradation being expressed by a "reconstruction index". The reconstruction index is then compared to a threshold. If the comparison indicates high degradation, i.e. a packet difficult to reconstruct, the packet is classified as "essential", otherwise it is classified as "supplementary". The two packet types are coded and transmitted normally through the network. The decision "essential packet" or "supplementary packet" determines the position of suitable switches in the transmitter and receiver in such a manner that, at the transmitter, after transmission of a supplementary packet, the predicted packet is coded instead of the original one, and the coded packet is also supplied to a local decoder and a local predictor in order to predict the subsequent packet. At the receiver, essential packets are decoded normally and supplied to the output. A local encoder is also provided for updating the decoder parameters in case of a missing packet, by using a packet predicted in a local predictor. A supplementary packet is decoded and emitted normally, but it is supplied also to the local predictor and encoder to keep the encoder parameters in alignment with the encoder parameters at the transmitter.

DPCM/ADPCM coding systems offer good performance for rates basically comprised in the interval 32 to 64 kbit/s, while at lower rates their performance strongly decreases as the rate decreases. At lower rates different coding techniques are used, more particularly analysis-by-synthesis techniques. Yet, also these techniques do not result in embedded codes, nor does the literature describe how an embedded code can be obtained. The paper by M. M. Lara-Barron and G. B. Lockhart states that the suggested method can also be applied to any low-bit rate encoder that utilises past information to decode current-frame samples, and hence theoretically such a method could be used also in case of analysis-by-synthesis coding techniques. However, even neglecting the fact that indications of performance are given only for 32 kbit/s ADPCM coding, the structure of transmitter and receiver is the typical structure of DPCM/ADPCM systems, comprising, in addition to the actual coding circuits at the transmitter and decoding circuits at the receiver, a decoder and a predictor at the transmitter and a predictor at the receiver. These devices are not provided for in the transmitters/-receivers of a system exploiting analysis-by-synthesis techniques, and their addition, besides that of the circuits for determining the reconstruction-index, would greatly complicate the structure of said transmitters/-receivers. Furthermore, since the coding/decoding circuits comprise a certain number of digital filters, the problem arises of correctly updating their memories.

OBJECT OF THE INVENTION

The object of the present invention is to provide a method of and a device for speech signal coding, allowing attainment of an embedded coding when using analysis-by-synthesis techniques, while keeping the typical structure of the transmitters/receivers of such systems unchanged.

BRIEF DESCRIPTION OF THE INVENTION

The method comprises a coding phase, in which at each frame a coded signal is generated which comprises information relevant to an excitation, chosen out of a set of possible excitation signals and submitted to a synthesis filtering to introduce into the excitation short-term and long-term spectral characteristics of the speech signal and to produce a synthesized signal. The excitation which is chosen is that which minimizes a perceptually-significant distortion measure, obtained by comparison of the original and synthesized signals and simultaneous spectral shaping of the compared signals, and a decoding phase wherein an excitation, chosen according to the information contained in a received coded signal out of a signal set identical to the one used for coding, is submitted to a synthesis filtering corresponding to that effected on the excitation during the coding phase. Embedded coding is generated for use in a network where the coded signals are organized into packets which are transmitted at a first bit rate and can be received at bit rates lower than the first rate but not lower than a predetermined minimum transmission rate. The various rates differ by discrete steps.

According to the invention, the sets of excitation signals for coding and decoding are split into a plurality of subsets, the first of which contributes to the respective excitation with such an amount of information as required for a transmission of the coded signals at the minimum transmission rate, while the other subsets provide contributions corresponding each to one of said discrete steps, the contributions of said other subsets being used in a predetermined succession and being added to the contributions of the first subset and of previous subsets in the succession;

during the coding phase the contributions supplied by all subsets of excitation signals are filtered in such a manner that, at each frame, the memory of the filtering results relevant to one or more preceding frames is taken into account only when filtering the excitation contribution of the first subset, while the excitation contributions of all other subsets are filtered without taking into account the results of the filtering relevant to preceding frames;

still during the coding phase, the contributions to the coded signal supplied by different subsets are inserted into different packets which can be distinguished from one another, the decrease from the first rate to one of the lower rates being achieved by first discarding packets containing the excitation contribution which has led to the attainment of the first rate and then packets containing the excitation contribution corresponding to preceding increase steps;

during the decoding phase, for each frame, the excitation contributions of the first subset are submitted to the synthesis filtering whatever the bit rate at which the coded signals are received and, if such a rate is higher than the minimum rate, even excitation contributions of the subsets corresponding to the steps which have led to such a rate, are filtered, the filtering of the excitation signals in the first subset being a filtering with memory and the filtering of the excitation signals in the other subsets being a filtering without memory.

A device for implementing the method comprises a coder including:

a first excitation source supplying a set of excitation signals wherein an excitation to be used for coding operations relevant to a frame of samples of the speech signal is chosen;

a first filtering system which imposes on the excitation signals the short-term and long-term spectral characteristics of the speech signal and supplies a synthesized signal;

means for carrying out a perceptually significant measurement of the distortion of the synthesized signal in comparison with the speech signal, for searching an optimum excitation which is the excitation which minimizes the distortion, and for generating coded signals comprising information relevant to the optimum excitation signal; and means to organise a transmission of coded signals as a packet flow; and a decoder including:

means for extracting the coded signals from a received packet flow;

a second excitation source supplying a set of excitation signals corresponding to the set supplied by the first source, an excitation corresponding to the one used for coding during a frame being chosen in said set on the basis of the excitation information contained in the coded signal; and a second filtering system, identical to the first one, which generates a synthesized signal during decoding.

According to the invention the first source of excitation signals comprises a plurality of partial sources each arranged to supply a different subset of the excitation signals, the subset supplied by a first partial source contributing to the coded signal with a bit stream necessary to obtain a packet transmission at a minimum bit rate, while the subsets of the other partial sources contribute to the coded signal with bit streams that, successively added to the contribution supplied by the first partial source, originate an increase of the bit rate by discrete steps up to a maximum bit rate;

the second source of excitation signals comprises a plurality of partial sources supplying respective subsets of the excitation signals corresponding to the subsets supplied by the partial sources of the first excitation signals;

the first and second filtering systems comprise each a first filtering structure which is fed with the excitation signals belonging to the first subset and, during the filtering relevant to a frame, processes them exploiting the memory of the filterings relevant to preceding frames, and further filtering structures, which are each associated with one of the other subsets of excitation signals and which, during the filterings relevant to a frame, process the relevant signals without exploiting the memory of the filtering relevant to the preceding frames;

the means for measuring distortion and searching the optimum excitation supply the means generating the coded signal with an excitation comprising contributions from all subsets of excitation signals;

the means for organizing the transmission into packets introduce into different packets the excitation information originating form different subsets of excitation signals; and the second filtering system supplies the signal synthesized during decoding by processing an excitation always comprising a contribution from the first subset of excitation signals, and comprising contributions from one or more further subsets only if the packet flow relevant to a frame of samples of speech signal is received at a higher rate than the minimum rate.

Coding systems using CELP (Codebook Excited Linear Prediction) technique, which is an analysis-by-synthesis technique, are also known, where the excitation codebook is subdivided into partial codebooks. An example is described by I. A. Gerson and M. A. Jasuk in the paper entitled: "Vector Sum Excited Linear Prediction (VSELP) Speech Coding at 8 kbps" presented at the International Conference on Acoustics, Speech and Signal Processing (ICASSP 90), Albuquerque (USA), Apr. 3–6, 1990. However, these systems are employed in fixed rate networks, and hence also at the receiving side the excitation always comprises contributions of all partial codebooks and the problem of tuning the filters at the transmitter and at the receiver does not exist.

The invention also provides a method of transmitting signals coded by analysis-by-synthesis techniques with the coding method and the coding device according to the invention.

BRIEF DESCRIPTION OF THE DRAWING

The invention will become more apparent with reference to the accompanying drawing, which shows the implementation of the invention using the CELP technique and in which.

SPECIFIC DESCRIPTION

Prior to describing the invention, we sill shortly disclose the structure of a speech-signal CELP coding/decoding system. As know, in such systems the excitation signal for the synthesis filter simulating the vocal tract consists of vectors, obtained e.g. from random sequences of Gaussian white noise, chosen out of a convenient codebook. During the coding phase, for a given block of speech signal samples, the vector is to be sought which, supplied to the synthesis filter, minimizes perceptually-significant distortion measure, obtained by comparing the synthesized samples and the corresponding samples of the original signal, and simultaneous weighting by a function which takes into account also how human perception evaluates the distortion introduced. This operation is typical of all systems based on analysis-by-synthesis techniques, which differ in the nature of the excitation signal.

Figure 1:
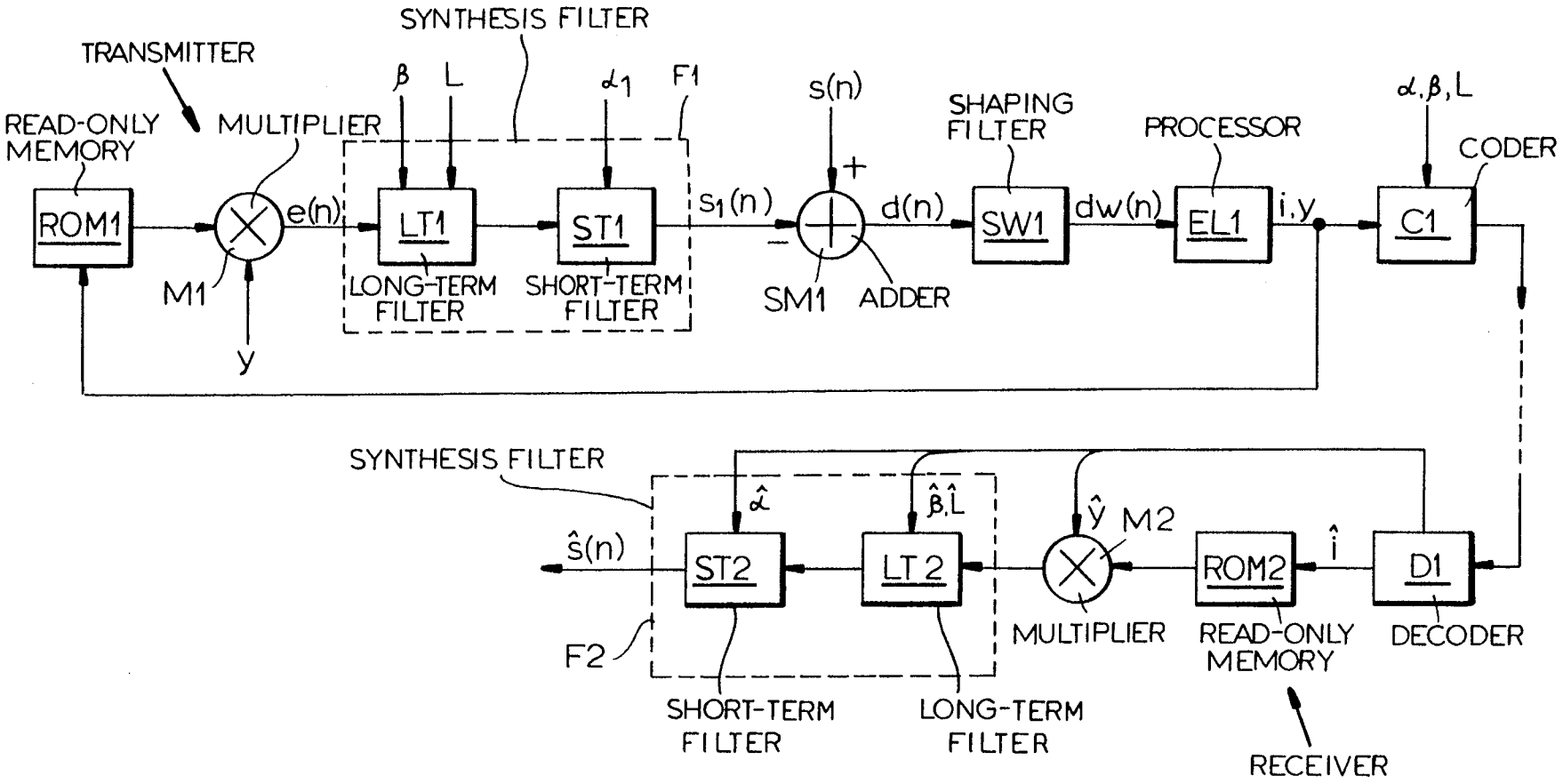
FIG. 1 is a block diagram of a conventional CELP coder.

With reference to FIG. 1, the transmitter of a CELP coding system can be seen to comprise:

a filtering system F1 (synthesis filter) simulating the vocal tract and comprising the cascade of long-term synthesis filter (predictor) LT1 and of a short-term synthesis filter (predictor) ST1, which introduce into the excitation signal the characteristics depending on the fine spectral structure of the signal (more particularly the periodicity of voiced sounds) and those depending on the spectral envelope of the signal, respectively. A typical transfer function of the long term filter is $$B(z)=1/(1-\beta z^{-L}) \quad (1)$$

where $z^{-1}$ is a delay by one sampling interval, $\beta$ and L are the gain and the delay of the long-term synthesis (the latter being the pitch period or a multiple thereof in case of voiced sounds). A typical transfer function for the short-term filter is $$A(z)=1/(1-\Sigma\alpha_i z^{-i}) \quad (2)$$

where $\alpha_i$ is a vector of linear prediction coefficients, determined from input signal s(n) using the well known linear prediction technique, and the summation extends to all samples in the block.

A read only memory ROM1 which contains the codebook of vectors (or words), which, weighted by a scale factor $\gamma$ in a multiplier M, form the excitation signal e(n) to be filtered in F1; a same scale factor, previously determined, can be used for the whole search for an optimum vector (i.e. the vector minimizing the distortion for the block of samples being coded), or an optimum scale factor for each vector can be determined and used during the search.

An added SM1, which carries out the comparison between the original signal s(n) and the filtered signal s1(n) and supplies an error signal d(n) consisting of the difference between said two signals.

a filter SW for spectrally shaping the error signal, so as to render the differences between the original and the reconstructed signal less perceptible; typically SW has a transfer function of the type $$W(z)=(1-\Sigma\alpha_i z^{-i})/(1-\Sigma\alpha_i\lambda i\, z^{-i}) \quad (3)$$

where $\lambda$ is an experimentally determined constant corrective factor (typically, of the order of 0.8–0.9) which determines the band increase around the formats; this filter could be located upstream SM1, on both inputs, so that SM1 directly gives the weighted error: in such case, the transfer function of ST1 becomes $1/(1-\Sigma\alpha_i\lambda^i z^{-i})$.

A processing unit EL1 which carries out the operation necessary for searching the optimum excitation vector and possibly optimizing the scale factor and the long-term filter parameters.

The coded signal, for each block, consists of index i of the optimum vector chosen, scale factor $\gamma$, delay L and gain $\beta$ of LT1, and coefficients $\alpha_i$ of ST1, duly quantized in a coder C1. Clearly, the filters in F1 ought to be reset at each new block to be coded.

The receiver comprises a decoder D1, a second read-only memory ROM2, a multiplier M2, and a synthesis filter F2 comprising the cascade of a long-term synthesis filter LT2 and a short-term synthesis filter ST2, identical respectively to devices ROM1, M1, F1, LT1, ST1 in the transmitter. Memory ROM2, addressed by decoded index $\hat{i}$, supplies F2 with the same vector as used at the transmitting side, and this vector is weighted in M2 and filtered in F2 by using scale factor $\gamma$ and parameters $\hat{\alpha}$, $\hat{\beta}$, $\hat{L}$, of short term and long term synthesis corresponding to those used in the transmitter and reconstructed starting from the coded signal; output signal s(n) of filter F2, converted again if necessary into analog form, is supplied to utilizing devices.

In the particular case of use in an ATM network (or in general in a packet switched network) downstream of the encoder there are devices for organizing the information into packets to be transmitted, and upstream of the decoder there are devices for extracting from packets received the information to be decoded. These devices are well known to a worker skilled in the art, and their operation do not affect coding/decoding operations.

Figure 2:
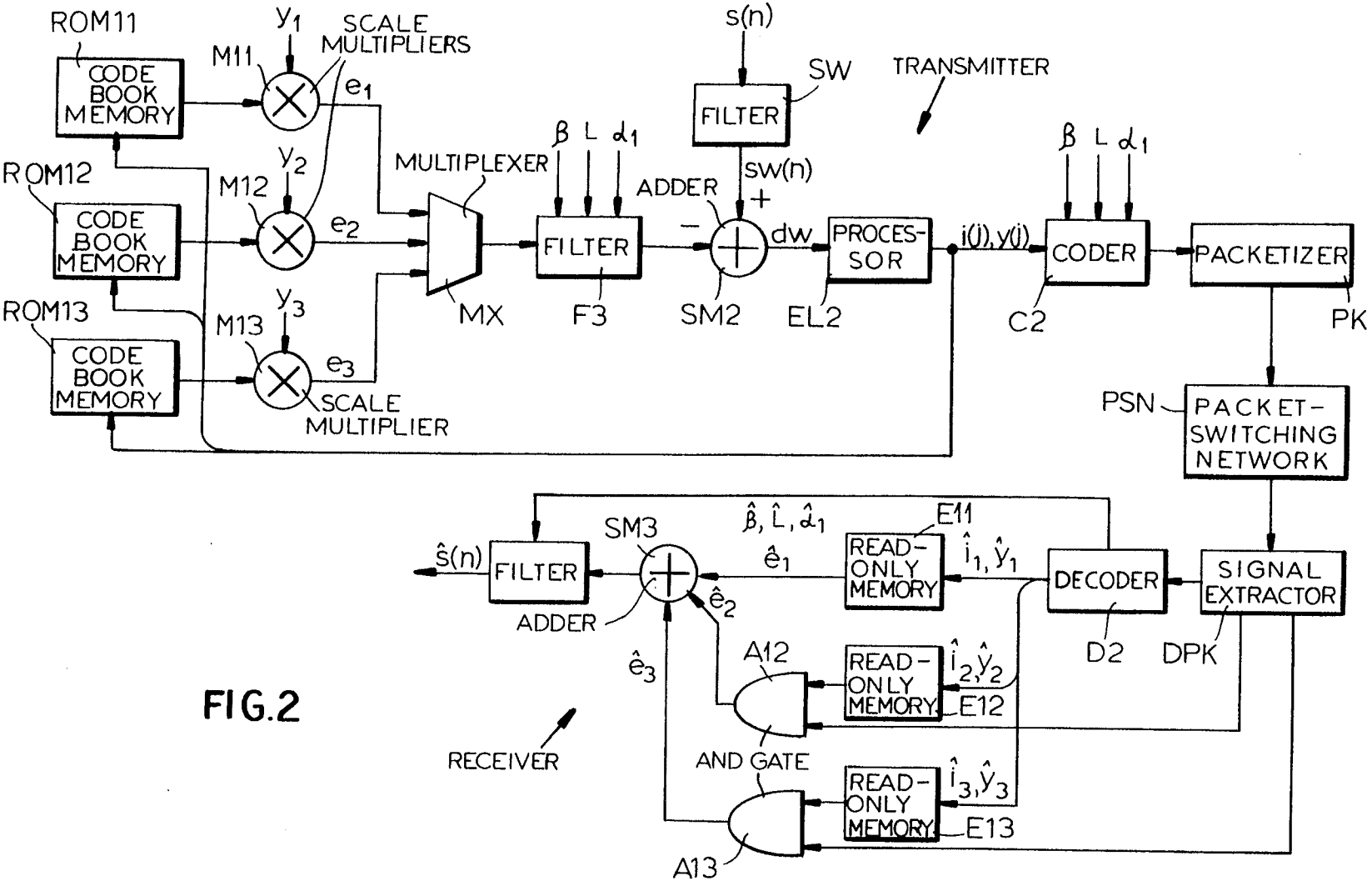
FIG. 2 is a block diagram of a coder according to the invention.

FIG. 2 shows the embedded coder of the Invention. By way of a non-limiting example, it will be supposed that such a coder is used in a packed switched network PSN (more particularly, an ATM network) where it is possible to drop a number of packets (independently of their nature) to reduce the transmission rate in case of overload. For simplicity and clarity of description, reference will be made to a speech coder capable of operating at 9.6, 8 or 6.4 kbit/s according to traffic conditions. Said rates lie within the range for which analysis-by-synthesis coders are typically used.

To implement the embedded coding, the excitation codebook is split into three partial codebooks. The first partial codebook contains such a number of vectors as to contribute to the coded signal with a bit stream that, added to the bit stream produced by the coding of the other parameters (scale factor and filtering system parameters), gives rise to the minimum transmission rate of 6.4 kbit/s; the second and third partial codebooks have such a size as to provide the contribution required by a transmission rate of 1.6 kbit/s. ROM11, ROM12, ROM13 denote the memories containing the partial codebooks; M11, M12, M13 denote the multipliers that weight the codevectors by the respective scale factors $\gamma_1\gamma_2$, $\gamma_3$, giving excitation signals $e_1$, $e_2$, $e_3$. The transmitter always operates at 9.6 kbit/s, and hence the coded signal comprises, as far as the excitation is concerned, the contributions provided by the three above-mentioned signals. Advantageously, to keep the total number of bits to be transmitted limited, the filtering system will be identical (i.e. it will use the same weighting coefficients) for all excitations. Therefore the figure shows a single filter F3 connected to the outputs of multipliers M11, M12, M13 through a multiplexer MX. For drawing simplicity the two predictors in F3 have not been indicated. In the diagram it has also been supposed that spectral weighting is effected separately on input signal s(n) and on the excitation signals, so that adder SM2 (analogous to SM1, FIG. 1) directly gives weighted error dw. Filter SW is hence indicated only on the path of s(n), since its effect on the excitation is obtained by a suitable choice of short term synthesis filter F3, as already explained. EL2 denotes the processing unit which performs the search for the optimum vector within the partial codebooks and the operations required for optimizing the other parameters (in particular, scale factor and gain of long-term filter) according to any of the procedures known in the art. C2 denotes a device having the same functions as C1 in FIG. 1. Clearly, the coded signals will comprise indices i(j) (j=1, 2, 3) of the optimum vectors chosen in the three partial codebooks and the respective optimum scale factor. $\gamma(j)$.

Quantizer C2 is followed by device PK packetizing the coded speech signal in the manner required by the particular packet switching network PSN. The excitation contribution of the different codebooks will be introduced by PK into different packets labeled so that they can be distinguished in the different networks nodes. This can be easily obtained by exploiting a suitable field in the packet header. Thus, in case of overload, a node can drop first the packets containing the excitation contribution from $e_3$ and then the packets containing contribution from $e_2$; the packets with the contrition from $e_1$ are on the contrary always forwarded through the network, and form the minimum 6.4 kbit/s data flow guaranteed.

At the receiver, a device DPK extracts from the packets received the coded speech signals and sends them to decoding circuit D2, analogous to D1 (FIG. 1), which is connected to three sources of reconstructed excitation E11, E12, E13. Each source comprises a read-only-memory, addressed by a respective decoded index $\hat{i}1$, $\hat{i}2$,$\hat{i}3$ and containing the same codebook as ROM11, ROM12, ROM13, respectively, and a multiplier, analogous to multiplier M2 (FIG. 1) and fed with a respective decoder scale factor $\hat{\gamma}_1$, $\hat{\gamma}_2$, $\hat{\gamma}_3$. Depending on the rate at which the speech signal is received, synthesis filter F4, analogous to filter F2 of FIG. 1, will receive the only excitation supplied by E11 (in case 6.4 Kbit/s are received) or the excitation from E11 and E12 (8 kbit/s) or the excitations supplied by E11, E12, E13 (9.6 kbit/s). This is schematized by adder S3, which directly receives the signals from E11 and receives the output signals of E12, E13 through AND gates A12, A13 enabled e.g. by DPK when necessary.

For drawing simplicity neither the various timing signals for the transmitter and receiver components, nor the devices generating them are indicated; on the other hand timing aspects are not affected by the invention.

To keep a good quality of the reconstructed signal, the filter operation at the transmitter and the receiver must be as uniform as possible. In accordance with the invention, taking into account that at least the data flow at minimum speed is guaranteed by the network, the coder has been optimised for such minimum speed. This corresponds to carrying out coding/decoding in a frame by exploiting the memory contribution of filters F3, F4 relevant to the only first excitation, whilst the second and the third excitations are submitted to a filtering without memory. In other terms, the optimization procedure is carried out by taking into account the filterings carried out in the preceding frames for the search of a vector in ROM11, and by taking into account the only current frame for the search in ROM12, ROM13. As a consequence, even at the receiver, only the filtering of excitation signals e1 will take into account the results of the previous filterings.

Figure 3:
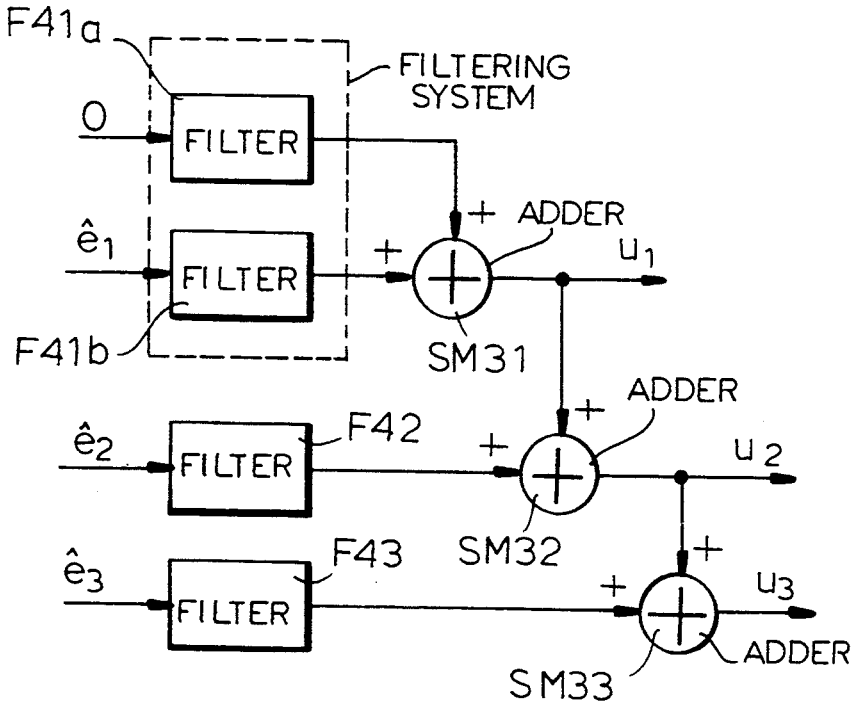
FIG. 3 and FIG. 4 are block diagrams of the filtering system of the receiver and transmitter of the system of FIG. 2.
Figure 4:
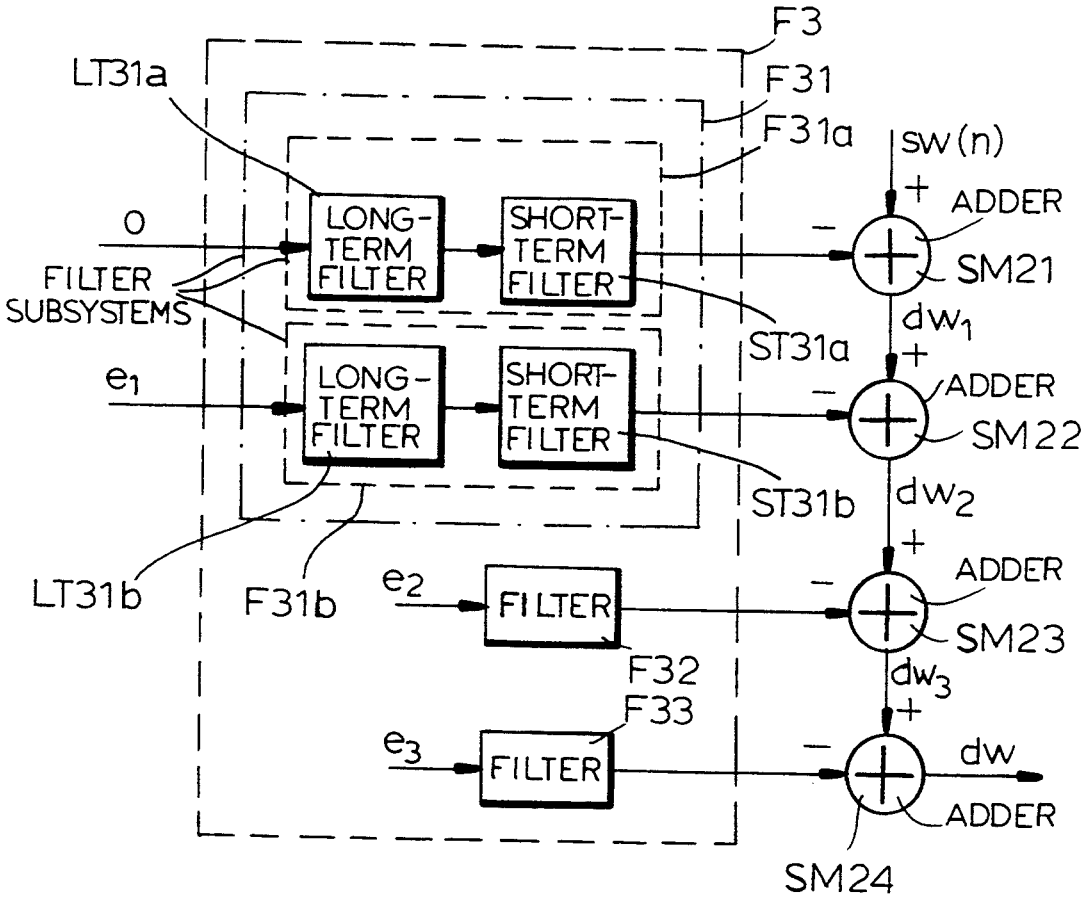

The basic diagrams of the receiver and the transmitter under these conditions are represented in FIGS. 3 and 4. For a better understanding of those diagrams and of the following one it is to be taking into account that a digital filter with memory can be schematized by the parallel connection of two filters having the same transfer function as the one considered. The first filter is a zero input filter, and hence its output represents the contribution of the memory of the preceding filterings, while the second filter actually processes the signal to be filtered, but it is initialized at each frame by resetting its memory (supposing for simplicity that the vector length coincides with the frame length). Furthermore, a filtering without memory is a linear operation, and hence the superposition of effects applies. In other terms, with reference to FIG. 2, in case of reception at a rate exceeding the minimum, filtering without memory the signal resulting from the sum of e1, e2, and possible e3 corresponds to summing the same signals filtered separately without memory.

In FIG. 3 filtering system F4 of FIG. 2 is represented as subdivided into three subsystems F41, F42, F43 for processing excitations ê1, ê2, ê3, respectively. Subsystem F41 carries out a filtering with memory, and hence it has been represented as comprising zero-input element F41*a* and element F41*b* filtering excitation e1 without memory. The outputs of elements F41*a*, F41*b* are combined in added SM31, whose output u1 conveys the reconstructed digital speech signal in case of 6.4 kbit/s transmission. Subsystems F42, F43 filter e2, e3 without memory and hence are analogous to F41*b*. The output signal of filter F42 is combined with the signal on u1 in an adder SM32, whose output u2 conveys the reconstructed digital speech signal in case 8 kbit/s are received. Finally, the output signal of filter F43 is combined with the signal present on u2 in an adder SM33, whose output u3 conveys the reconstructed digital speech signal in case of 9.6 kbit/s transmission.

The diagram of FIG. 4 is quite similar: F31 (F31*a*, F31*b*), F32, F33 are the subsystems forming F3, and SM21, SM22, SM23, SM24 is a chain of adders generating signal dw of FIG. 2. More particularly, the output signal of F31*a*, i.e. the contribution of the memories of filtering of excitation $e_1$, is subtracted from weighted input signal sw(n) in SM21, yielding a first partial error dw1; the output signal of F31*b*, i.e. the result of the filtering without memory of $e_1$, is subtracted from dw1 in SM22 yielding a second partial error signal dw2; the contribution due to filtering without memory of $e_2$ is subtracted from dw2 in SM3, yielding a signal dw3, from which the contribution due to the filtering without memory of $e_3$ is subtracted in SM24. For a better understanding of the following diagrams the cascade of long-term and short-term predictors LT31*a*, ST31*a* and LT31*b*, ST31*b* is explicitly indicated in F31*a*, F31*b*. All predictors in the various elements have transfer functions given by (1) or (2), as the case may be.

Figure 5:
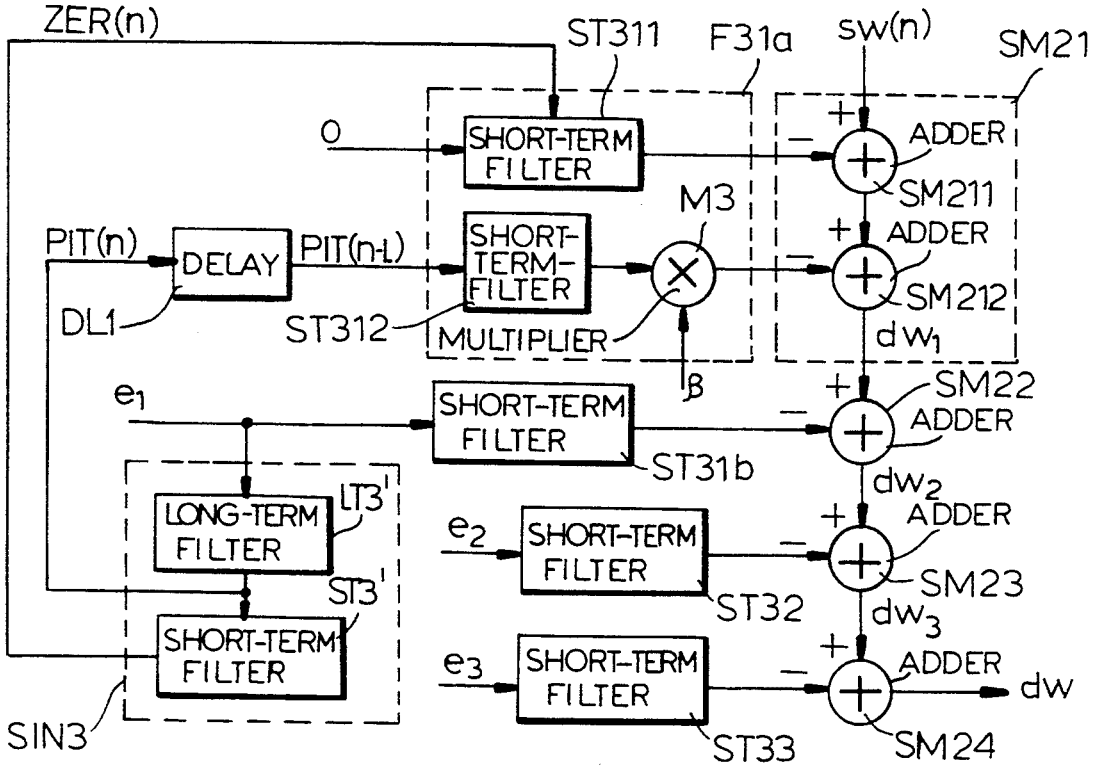
FIG. 5 is a functional diagram of the filtering system in the transmitter.

FIG. 5 shows the structure of filtering system F3, under the hypothesis that the length of a frame coincides with the length of the vectors in the excitation codebook and that delay L of long-term predictors is greater than the vector length. This choice for the delay is usual in CELP coders. Corresponding devices are denoted by the same reference characters used in FIGS. 4 and 5.

Element F31*a* simply comprises tow short-term filters ST311, ST312 and multiplier M3, in series with ST312, which carries out the multiplication by factor $\beta$ which appears in (1). Filter ST311 is a zero input filter, whilst ST312 is fed, for processing the n-th sample of a frame, with output signal PIT(n−L), relevant to L preceding sampling instants, of a long-term synthesis filter LT3′ which receives the sample of $e_1$ (FIG. 2) and, with a short-term synthesis filter ST3′, forms a fictitious synthesizer SIN3 serving to create the memories for element F31*a*.

This structure has the same functions as the cascade of LT31*a* and ST31*a* in FIG. 4. In fact, at instant n, a filter such as LT31*a* (with zero input) would supply ST31*a* with the filtered signal relevant to instant n-31 L, weighted by factor $\beta$. This same signal can be obtained by delaying the output signal of LT3′ by L sampling instants in a delay element DL1, so that LT31*a* can be eliminated. ST31*a*, as disclosed above, can be split into two filters ST311, ST312 with zero input and memory and with input PIT(n−L) and without memory, respectively. The memory for ST311 will consist of output signal ZER(n) of ST3′. The output signal of ST311 is fed to the input of an added SM211, where it is subtracted from signal sw(n), and the output signal of the cascade of ST312 and M3 is connected to an adder SM212, where it is subtracted from the output signal of SM211; the two adders carry out the functions of adder SM21 in FIG. 5.

Element F31*b* without memory comprises only short-term synthesis filter ST31*b*: in fact, with the hypothesis made for delay L, long-term synthesis filter LT31*b* would let through the input signal unchanged, since the output sample to be used for processing an input sample would be relevant to the preceding frames. For the same reasons, filters F32, F33 of FIG. 4 only comprise short-term synthesis filters, here denoted by ST32, ST33.

As stated, the circuit of FIG. 5 is based on the assumption that the frame length coincide with the length of the codebook vectors. Usually however the frames have a duration of the order of 20 ms (160 samples of speech signals at a sampling frequency of 8 kHz), and the use of vectors of such a length would require very big memories and give rise to high computing complexity for minimizing the error. Generally it it preferred to use shorter vectors (e.g. vectors with length $\frac{1}{4}$ of the frame duration) and subdivide the frames into subframes of the same length as a codebook vector, so that an excitation vector per each subframe is used for the coding. Thus, during a frame, the search for the optimum vector in each partial codebook is repeated as many times as the subframes are. In an ATM network, packet dropping for limiting the transmission rate takes place when passing from one frame to the next, whilst within the frame the rate is constant. Within a frame it is then possible to optimise the coder for the rate actually used in that frame, i.e. to take also into account the memories of filters F32, F33. The long-term prediction delay will still be greater than vector duration. Under these conditions also filters F32, F33 would have the structure shown for F31 in FIG. 5, with the only difference that at the end of each frame signals PIT and ZER relevant to $e_2$, $e_3$ will have to be reset, since only the memory of F31 is taken into account.

Figure 6:
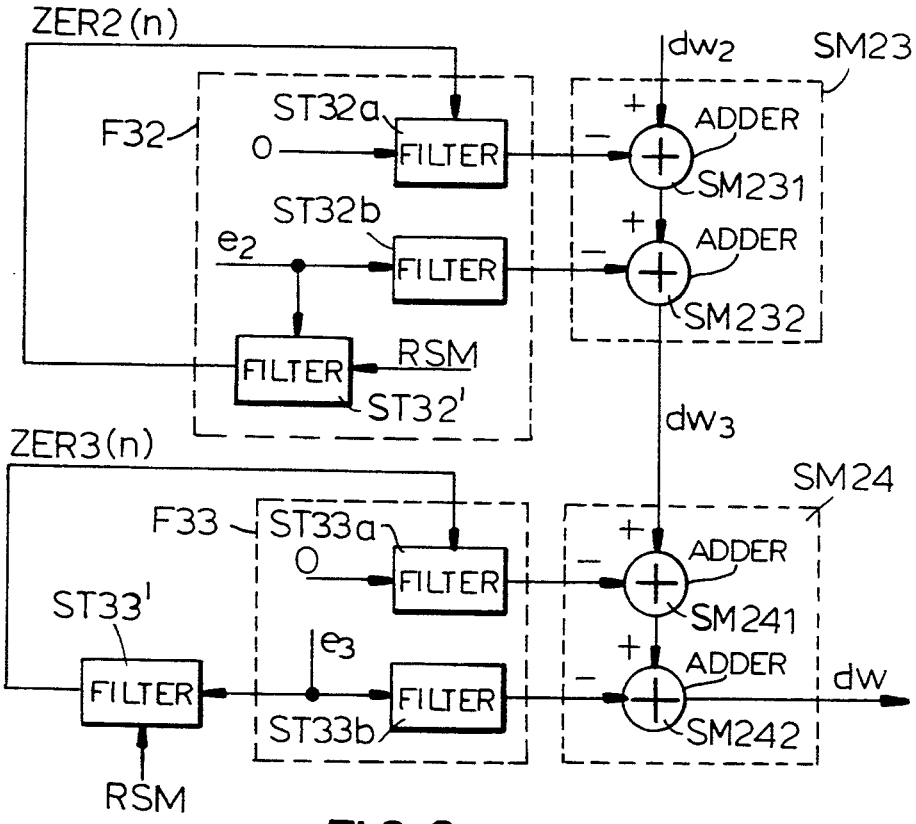
FIG. 6 is a partial diagram of a variant.

The structure can be simplified if long-term characteristics are not taken into account for filtering excitations $e_2$, $e_3$ (and hence $\hat{e}_2$, $\hat{e}_3$): in this case in fact the fictitious synthesizer relevant to each one of said excitations comprises only a short-term synthesis filter and the branch which receives signal PIT is missing. As shown in FIG. 6, under these conditions filtering subsystems F32, F33 comprise the three filters ST32*a*, ST32*b*, ST32′ and ST33*a*, ST33*b*, ST33′ respectively, analogous to ST311, ST31*b* and ST3′ (FIG. 5), and adders SM231, SM232 and SM241, SM242 forming adders S23 and S24, respectively. ZER2, ZER3 denote signals corresponding to ZER (FIG. 5), i.e. signals representing the memory contribution for filtering in F32, F33; finally, RSM denotes the reset signal of the memories of ST32′, ST33′, which is generated at the beginning of each new frame by the conventional devices timing the operations of the coding system.

It is clear that the above description has been given only by way of a non limiting example, variations and modifications being possible without going out of the scope of the invention. More particularly, even through reference has been made to a CELP coding scheme, the invention can apply to whatever analysis-by-synthesis coding system, since the invention is per se independent of excitation signal nature. More particularly, in case of multipulse coding, which with CELP coding is the most widely used, a first number of pulses will be used to obtain 6.4 kbit/s transmission rate, and two other pulse sets will provide the rate increase required to achieve the other envisaged speeds.

We claim:

1. A method of coding by analysis-by-synthesis techniques speech signals converted into frames of digital samples, comprising the steps of:

in a coding phase, generating at each frame a coded signal representing an excitation and constituted by a selected excitation signal, chosen out of a set of possible excitation signals for coding and submitted to a synthesis filtering to introduce into the selected excitation signal short-term and long-term spectral characteristics of a speech signal to be coded and to produce a synthesized signal, the excitation signal chosen being that which minimizes a perceptually-significant distortion measure obtained by comparison of the original and synthesized signals and simultaneous spectral shaping of the compared signals;

in a decoding phase subjecting an excitation signal, chosen out of an excitation signal set for decoding identical to the one used for coding with excitation information contained in a received coded signal, to a synthesis filtering corresponding to that effected on the excitation signal during the coding phase; and implementing an embedded coding for use in a network where the coded signals are organized into packets which are transmitted at a first bit rate and can be received at bit rates lower than the first bit rate but not lower tan a predetermined minimum transmission rate, the various rates differing by discrete steps, the embedded coding being implemented by:

splitting the sets of excitation signals for coding and decoding into a plurality of subsets, a first subset of which contributes to the respective excitation an amount of information required for transmission of the coded signals at the minimum transmission rate, while other subsets provide contributions corresponding each to one of said discrete steps, the contributions of said other subsets being used in a predetermined succession and being added to the contributions of the first subset and of preceding subsets in the succession to provide increase steps;

filtering during the coding phase the contributions supplied by all subsets of excitation signals in such a manner that, at each frame, a memory of a filtering result relevant to at least one preceding frame is taking into account only when filtering the contribution to the excitation signal of the first subset, while the contributions to the excitation signals of all other subsets are filtered without taking into account the results of the filtering relevant to preceding frames;

still during the coding phase, inserting the contributions supplied by different subsets into different signal packets which can be distinguished from one another, the decrease from the first rate to one of the lower rates being achieved by discarding first packets containing the excitation contribution which has led to the attainment of the first rate and then packets containing the contribution to the excitation signals corresponding to preceding increase steps; and during the decoding phase, receiving for each frame, the contribution to the excitation signals of the first subset if subjected to synthesis filtering whatever the bit rate at which the coded signal, and, if such a rate is higher than the minimum rate, filtering also contributions to the excitation signals of the subsets corresponding to the steps which have led to such a rate, the filtering of the contribution to the excitation signals of the first subset being a filtering with memory and the filtering of the contributions to the excitation signals of the other subsets being a filtering without memory, the synthesis filtering introducing into excitation signals a long-term characteristic only for the contribution of the first subset.

2. A device for coding and decoding speech signals by analysis-by-synthesis techniques, comprising:

a coder including:

a first excitation source supplying a set of excitation signals ($e_1$, $e_2$, $e_3$) from which an excitation to be used for coding operations for a frame of samples of the speech signal is chosen, a first filtering system for applying to the excitation signals short-term and long-term spectral characteristics of the speech signal and supplying a synthesized signal, means for carrying out a perceptually significant measurement of the distortion of the synthesized signal in comparison with the speech signal, for searching an optimum excitation which is the excitation minimizing the distortion, and for generating coded signals comprising information relevant to the optimum excitation, and means to organize a transmission of coded signals as a packet flow; and a decoder including:

means for extracting the coded signals from a received packet flow, a second excitation source supplying a set of excitation signals e1, e2, e3) corresponding to the set supplied by the first source, an excitation corresponding to the one used for coding during a frame being chosen in said set on the basis of the excitation information contained in the coded signal, and a second filtering system identical to the first filtering system which generates a synthesized signal during decoding, and wherein:

the first source of excitation signals comprises a plurality of partial sources each arranged to supply a different subset of the excitation signals, the subset ($e_1$) supplied by a first partial source contributing the coded signal with a bit stream necessary to obtain a packet transmission at a minimum bit rate, while the subsets ($e_2$, $e_3$) of the other partial sources contribute to the coded signal with bit streams that, successively added to the contribution supplied by the first partial source, originate an increase of the bit rate by discrete steps up to a maximum bit rate;

the second source of excitation signals comprises a plurality of partial sources supplying respective subsets of the excitation signals corresponding to the subsets supplied by the partial sources of the first excitation source;

the first and second filtering systems comprise each a first filtering structure which is fed with the excitation signals belonging to the first subset ($e_1$, $e_1$) and, during the filtering relevant to a frame, processes them exploiting the memory of the filterings relevant to preceding frames, and further filtering structures, which are each associated with one of the other subsets of excitation signals and which, during the filtering relevant to a frame, process the relevant signals without exploiting the memory of the filtering relevant to the preceding frames;

the means for measuring distortion and searching the optimum excitation supply the means generating the coded signal with an excitation comprising contributions from all subsets of excitation signals; the means for organizing the transmission into packets introduce into different packets the excitation information originating from different subsets of excitation signals; and the second filtering system supplies the signal synthesized during decoding by processing an excitation always comprising a contribution from the first subset of excitation signals (e1), and comprising contributions from one or more further subsets (e2, e3) only if the packet flow relevant to a frame of samples of speech signal is received at a higher rate than the minimum rate the first filtering structure containing a cascade of a short term synthesis filter and a long-term synthesis filter, and the further filtering structures consisting of a short-term synthesis filter.

* * * * *